US005477818A

United States Patent [19]

Ascari et al.

[11] Patent Number: 5,477,818

[45] Date of Patent: Dec. 26, 1995

[54] INTERNAL COMBUSTION ENGINE

[75] Inventors: Ennio Ascari, Formigine; Paolo Martinelli, Modena, both of Italy

[73] Assignee: Ferrari S.p.A., Modena, Italy

[21] Appl. No.: 285,623

[22] Filed: Aug. 4, 1994

[30] Foreign Application Priority Data

Aug. 6, 1993 [IT] Italy ..... TO93A0597

[51] Int. Cl.[6] ..... F02M 35/10; F02F 1/42

[52] U.S. Cl. ..... 123/51 R; 123/51 AA

[58] Field of Search ..... 123/51 R, 51 A, 123/51 B, 51 BC, 54.4, 52.1

[56] References Cited

U.S. PATENT DOCUMENTS

| | | | |
|---|---|---|---|
| 1,900,466 | 3/1933 | Schroeder | 123/51 A |
| 1,900,587 | 3/1933 | Schutzniedrig | 123/51 AA |
| 2,053,242 | 9/1936 | Kahn | 123/51 B |
| 2,329,480 | 9/1943 | Neuland | 123/51 B |
| 2,350,626 | 6/1944 | Mahan | 123/51 A |
| 2,720,794 | 10/1955 | Morris | 74/580 |
| 4,129,102 | 12/1978 | van der Lely | 123/51 B |
| 4,979,473 | 12/1990 | Lee | 123/41.35 |

FOREIGN PATENT DOCUMENTS

| | | | |
|---|---|---|---|
| 0105934 | 4/1984 | European Pat. Off. . | |
| 2466611 | 4/1981 | France . | |
| 315846 | 12/1934 | Italy | 123/51 R |
| 681849 | 10/1952 | United Kingdom . | |

*Primary Examiner*—David A. Okonsky

*Attorney, Agent, or Firm*—Shlesinger, Arkwright & Garvey

[57] ABSTRACT

An internal combustion engine presenting a number of cylinders, each defined by a respective axially symmetrical cavity formed in the engine block, and each defining, together with a piston sliding axially inside the cylinder and a head connected to the block, a combustion chamber served by a supply system on the head; the cylinders being divided into a first and second group, each composed of pairs of first and second cylinders arranged in a V and converging towards a respective drive shaft for each group; and the two groups being connected inverted and facing each other, so that the first and second cylinders in each pair of cylinders in the first group are connected at the respective head end so as to form a V with respective first and second cylinders in each corresponding pair of cylinders in the second group, and so that each pair of first cylinders in the two groups defines a first combustion chamber, and each pair of second cylinders in the two groups defines a second combustion chamber common to the respective pistons.

9 Claims, 2 Drawing Sheets

INTERNAL COMBUSTION ENGINE

BACKGROUND OF THE INVENTION

The present invention relates to a novel internal combustion engine design to reduce the length of engines with a large number of cylinders.

For both alternate mass balancing and more strictly thermodynamic reasons, high performance engines normally present a large number of cylinders, typically twelve or sixteen. As opposed to being arranged in-line as in the past, the cylinders are now arranged in a V composed of two lines or banks of six or eight side by side in-line cylinders converging in a V towards an ideal apex consisting of the drive shaft or crankshaft. Typically, the crankshaft is located at the bottom with the oil sump to catch the oil by gravity, and at the top the opposite ends of the diverging cylinders in the two banks are connected to two heads—one for each bank—with the timing systems and members.

A major drawback of the above designs is the considerable size involved both lengthwise, on account of the side by side arrangement of a large number of cylinders in one line or bank, and vertically, due to the presence of the supply members, particularly the intake and exhaust manifolds and engine valve control systems.

SUMMARY OF THE INVENTION

It is an object of the present invention to provide an engine designed to overcome the above drawbacks and which at the same time is relatively straightforward to produce.

According to the present invention, there is provided an internal combustion engine comprising a number of cylinders formed in the engine block and inside which respective pistons slide in fluidtight manner; and a number of combustion chambers, each defined by at least one cylinder, by the respective piston and by a head connected to the block, and each served by a supply system on the head; the cylinders being divided into a first and second group, each composed of pairs of first and second cylinders arranged in a V and converging towards a respective drive shaft for each group; characterized in that the cylinders in the two groups are connected inverted and facing one another, so that the first and second cylinders in the first group form respective first and second in-line banks connected, at the respective head end, so as to form a V with the first and second cylinders respectively of corresponding first and second in-line banks in the second group, and so that each pair of converging cylinders in the first banks of the two groups defines a first common combustion chamber, and each pair of converging cylinders in the second banks of the two groups defines a second common combustion chamber.

More specifically, said two groups of V cylinders are formed in a single common block wherein, in cross section, the cylinders are arranged in the form of a quadrilateral, and which presents, on either side, a first and second series of main bearings for a first and second drive shaft; respective first connections for a first and second oil sump; and, perpendicular to the first connections, second connections for a first and second head.

The resulting engine therefore presents what may be defined in general terms as a "superimposed twin V" design which, for a given piston displacement and number of cylinders, provides for drastically reducing both the length and height of the engine as compared with conventional currently .used designs, particularly those with in-line cylinders or V cylinders at any angle. The superimposed twin V design also provides for simplifying the structure, reducing the number of cylinder heads, and, more especially, for drastically reducing the weight of the engine for a given piston displacement and power.

According to the invention, the engine is installed with the first oil sump at the bottom and the second oil sump inverted at the top.

Moreover, the common block presents a first number of vertical passages formed at the respective converging ends of the first and second cylinders in each group, for maintaining constant hydraulic communication between the first and second oil sumps. Optionally, it also presents a second number of vertical passages for connecting the cylinders in each bank in each group to the corresponding cylinders in the corresponding bank in the other group at the respective side walls of the cylinders.

This therefore provides—in conjunction with oil supply nozzles for spraying oil on to the inner side of the piston crowns, and a screw type oil recovery system exploiting the splash to which the oil in the top sump is subjected by rotation of the relative drive shaft—for ensuring correct lubrication of all parts of the engine and continuous circulation of the oil between the two sumps despite the unfavourable (downturned) position of the second sump.

According to a further characteristic of the invention, said first and second common combustion chambers defined by the converging cylinders in the corresponding banks in the two groups present, in a plane parallel to that of the respective first and second heads, the form of an ellipse defined by interpenetration of the cylindrical side walls of said converging cylinders in the two groups; the angle between the axis of the cylinders in each pair of converging cylinders and the plane parallel to that of the respective head being so selected as to maximize the longer axis of the ellipse.

As such, the same block may be fitted with heads with both four and six valves for each combustion chamber (defined, in the example shown, by each pair of converging corresponding cylinders in the two groups), thus enabling low-cost production of perfected engines for various operating requirements. Also, by virtue of each combustion chamber being formed by the combined volume of two cylinders, unit "piston displacement" is fairly high, so that the design according to the present invention is particularly suitable for diesel engines with a relatively small overall piston displacement (e.g. less than 2000 cc).

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
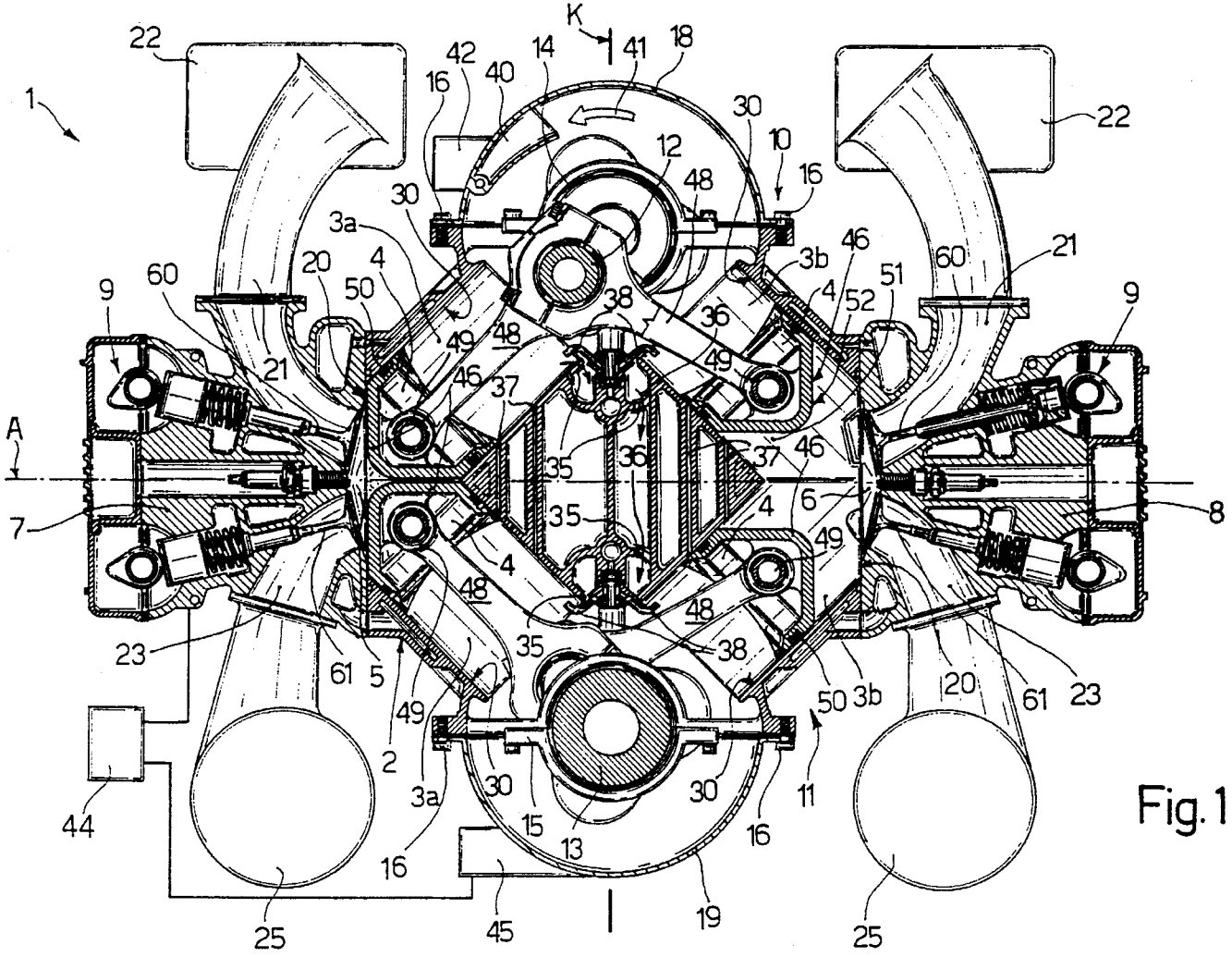
FIG. 1 shows a cross section of an engine in accordance with the present invention.
Figure 2:
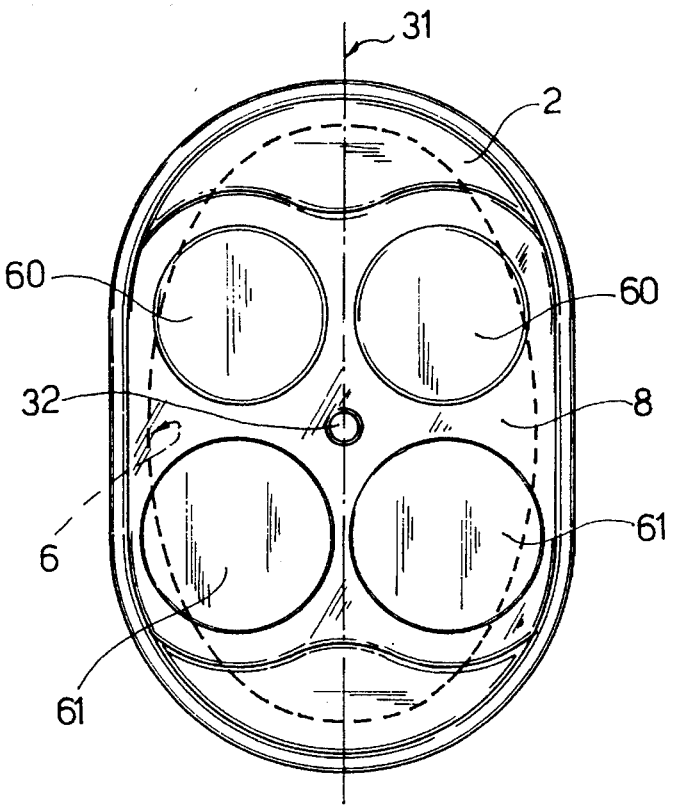
FIG. 2 shows a schematic detail, perpendicular to the FIG. 1 plane, of the head-block connection of the FIG. 1 engine at one of the combustion chambers.

With reference to FIGS. 1 and 2, number 1 indicates an internal combustion engine comprising a block 2; a number of cylinders 3*a*, 3*b* inside which respective pistons 4 slide in fluidtight manner; and a number of combustion chambers 5, 6, each defined by at least one cylinder 3, by the respective piston 4, and by a head 7, 8 connected to block 2, and each served by a respective known supply and timing system 9 on the respective head 7, 8.

Cylinders 3 are defined by respective symmetric cylindrical cavities formed in block 2, and according to the present invention are divided into a first group 10 and a second group 11, each composed of pairs (only one shown in FIG. 1) of first cylinders 3*a* and second cylinders 3*b* arranged in a known V formation and converging towards a respective drive shaft 12 (for group 10) and 13 (for group 11). The rotation axes of shafts 12 and 13 are parallel to each other and lie in the same plane K (FIG. 1) defining the longitudinal vertical plane of symmetry of engine 1. The corresponding cylinders in groups 10 and 11 are arranged, in known manner (not shown), side by side and in-line to form respective first banks (cylinders 3*a*) and second banks (cylinders 3*b*) of the same and any predetermined number of cylinders.

According to the present invention, the banks of cylinders 3*a*, 3*b* in group 10, which are thus arranged in a V converging towards shaft 12, are also connected (FIG. 1) at the respective head 7, 8 end so as to form a V with the corresponding banks of cylinders 3*a*, 3*b* in group 11 in turn arranged in a V and converging towards shaft 13, so that the V defined by the two banks of cylinders in group 10 is connected inverted and facing the V defined by the banks in group 11.

More specifically, and as shown clearly in FIG. 1, cylinders 3*a* in group 10 are connected inverted, facing and at an angle to the corresponding cylinders 3*a* in group 11; and cylinders 3*b* in group 10 are symmetrically connected inverted, facing and at an angle to the corresponding cylinders 3*b* in group 11, so that each pair of converging cylinders 3*a* in the first banks in groups 10, 11 defines a common combustion chamber 5, and each pair of converging cylinders 3*b* in the second banks in groups 10, 11 defines a common combustion chamber 6 opposite and symmetrical with chamber 5.

More specifically, block 2 consists of a single one-piece parallelepiped element (e.g. a one-piece cast iron or light alloy casting) shown in cross section in FIG. 1; and the cylindrical cavities defining the banks of cylinders 3*a*, 3*b* of groups 10, 11 in block 2 are formed parallel to the lateral faces of the block. As such, engine 1 is composed of a number of side by side modules identical to the one shown in FIG. 1, of the same number as the cylinders in each bank, and wherein the axes of the four cylinders constituting the module (a pair of cylinders 3*a*, 3*b* in group 10, and a corresponding coplanar, facing pair of cylinders 3*a*, 3*b* in group 11) are arranged in the form of a quadrilateral, in particular a square. That is, at the axis of intersection A perpendicular to plane K, cylinder 3*a* in group 10 forms a 90° angle with cylinder 3*a* in group 11; at axis A, but on the opposite side, cylinder 3*b* in group 10 forms a 90° angle with cylinder 3*b* in group 11; and each cylinder 3*a* forms a 90° angle with cylinder 3*b* in the same group.

Consequently, combustion chambers 5 and 6 of each engine module are defined by the combined volume of two converging cylinders 3*a* or 3*b* in groups 10 and 11, by respective cylindrical side walls 30 of cylinders 3, by a pair of respective pistons 4 mounted in sliding manner inside respective cylinders 3, and by heads 7 and 8 respectively. Also, on account of the oblique position and the selected angle of incidence of cylinders 3, combustion chambers 5 and 6 present, in a plane parallel to plane K and substantially adjacent and parallel to that of respective first and second heads 7 and 8 (FIGS. 2 and 3), the form of an ellipse defined by interpenetration of the respective cylindrical side walls 30 of respective pairs of cylinders 3*a* or 3*b* converging towards axis A.

Figure 3:
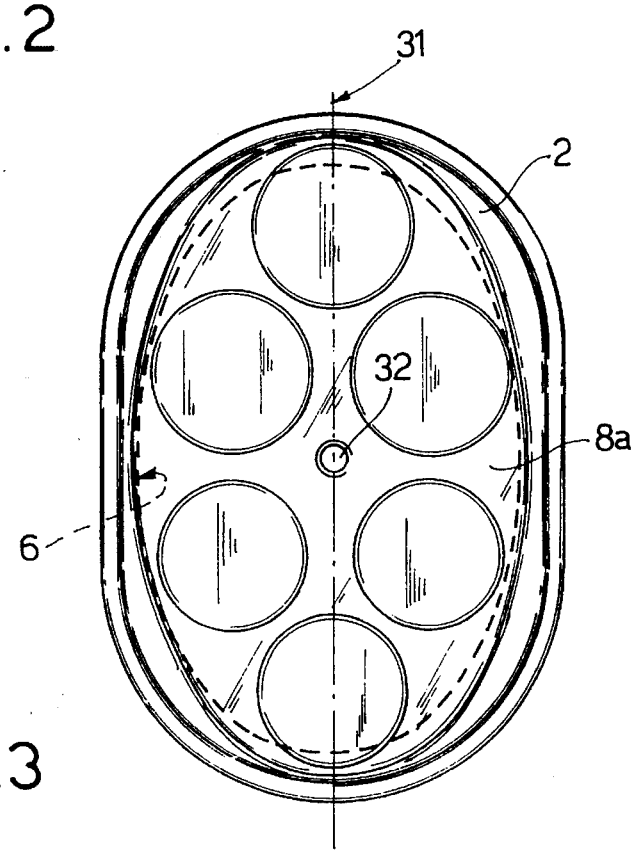
FIG. 3 shows a schematic view of a possible variation of the FIG. 2 detail.

More specifically, and as shown clearly in FIGS. 2 and 3 showing combustion chamber 6 in FIG. 1, the angle of convergence of the cylinders, or rather the angle formed between the axis of the cylinders in each pair of converging cylinders 3*a* or 3*b* and said plane parallel to that of respective head 7 (for cylinders 3*a*) or 8 (for cylinders 3*b*), is so selected as to maximize the longer axis 31 of the ellipse, thus enabling block 2 to be fitted with both a head like head 8 (7 for combustion chamber 5—FIG. 2), and, according to a possible variation, a head 8*a* with respectively four and six valves for each combustion chamber 5 or 6. In both cases, at axis A, head 8 or 8*a* (7 on the other side of the engine) may be provided with a seat 32 (or, according to a variation not shown, a number of side by side seats 32 on either side of axis A) for one or more known sparking plugs.

Block 2 presents a first series of main bearings 14 at the top for shaft 12; a second series of main bearings 15 at the bottom for shaft 13; respective connections 16 for a first oil sump 18 at the top and for a second oil sump 19 at the bottom; and, perpendicular to connections 16 and on either side of block 2, respective mounting surfaces 20 for respective heads 7 and 8, to which heads 7 and 8 are fitted in known fluidtight manner (not shown), e.g. by means of studs and respective gaskets.

According to the preferred embodiment shown, engine 1 is therefore installed with oil sump 19 at the bottom, oil sump 18 inverted at the top, and heads 7 and 8 opposed horizontally as in a "boxer" engine. Heads 7 and 8 comprise respective intake pipes 21 at the top, extending on either side of and surrounding top oil sump 18, and inserted inside respective known intake chambers 22 substantially aligned with the top of sump 18; and respective exhaust pipes 23 at the bottom, extending on either side of bottom oil sump 19, and inserted inside respective exhaust manifolds 25 parallel to bottom shaft 13 and substantially aligned with the bottom of sump 19.

To ensure effective oil circulation despite the unfavourable (downturned) position of practically half the engine, i.e. group 10, block 2 presents a first number of vertical passages 35 formed at the respective converging ends of pairs of cylinders 3*a* and 3*b* in each group 10, 11, for maintaining constant hydraulic and pneumatic communication of oil sumps 18 and 19 as shown in FIG. 1 by arrows 36 indicating the path along which oil from sump 18 drops down into bottom sump 19, and for ensuring the same pressure in both sumps 18, 19.

Optionally, provision is also made for a second number of vertical passages 37 connecting cylinders 3*a* in top group 10 to cylinders 3*a* in bottom group 11, and cylinders 3*b* in group 10 to cylinders 3*b* in group 11 at the side walls 30 of the cylinders. Oil is supplied to the cylinders by known nozzles 38 for spraying pressurized oil on to the inner side of the crown of pistons 4 and so also cooling the pistons. More specifically, each cylinder 3 is provided with at least one nozzle 38 located at the end of the cylinder facing respective drive shaft 12 or 13; each nozzle 38 in turn facing the opposite end of the cylinder, for spraying oil on to the respective crown 46 of respective piston 4, on the opposite side to respective combustion chamber 5 or 6.

The lubricating system is completed by a screw type oil recovery device 40 located tangentially inside sump 18 and which provides for catching the oil thrown towards the top of sump 18 by drive shaft 12 rotating in the direction of arrow 41. Device 40 is connected to an appropriately sized salvage pump 42 which draws up the collected oil and feeds it to a tank 44 external to engine 1 and from which the oil is drawn in known manner (not shown) for supply to nozzles 38. Sump 19 also presents a similar pump 45 but, being positioned favourably to collect the oil by gravity, does not require a device 40.

In the preferred embodiment shown, each piston 4 presents a convex crown 46 with its convexity towards combustion chamber 5 or 6, and is connected by a respective connecting rod 48 to drive shaft 12 or 13 by means of a pin 49 located upstream from a piston sealing element 50 in relation to the combustion chamber. More specifically, each piston 4 presents a saddle-shaped crown 46 towards combustion chamber 5 or 6 and defined by a pair of substantially perpendicular faces; and the stroke of pistons 4 is so selected that, in the top dead center position (shown to the left in FIG. 1), respective first faces 51 of pistons 4 are positioned facing and adjacent to each other and parallel to and on either side of the axis of incidence A of the respective pair of cylinders in groups 10, 11; while respective second faces 52 of pistons are positioned parallel to, substantially coplanar with, and facing respective head 7 or 8.

Heads 7 and 8 are preferably so formed as to define, in cross section, a "roofed" type combustion chamber in relation to each pair of converging cylinders 3*a*, 3*b* respectively. With reference also to FIG. 2, heads 7, 8 therefore present respective supply valves 60 and drain valves 61 arranged obliquely in relation to each other and facing faces 52 of pistons 4. Finally, in the top dead center position, a very small amount of clearance is provided between faces 51 and between faces 52 and respective head 7 or 8, so as to achieve a strong squeezing effect and hence considerably greater swirl. It should be pointed out that this is achieved partly by the relative motion of faces 52 towards the plane of heads 7, 8 as pistons 4 move into the top dead center position, and to a greater extent (because the relative speed is greater) by the relative motion of faces 51 of adjacent pistons 4 towards each other as the pistons move into the top dead center position, and by the fact that the cylinders of the pistons converge into one combustion chamber 5 or 6.

We claim:

1. An internal combustion engine comprising a number of cylinders formed in the engine block and inside which respective pistons slide in fluidtight manner; and a number of combustion chambers, each defined by at least one cylinder, by the respective piston and by a head connected to the block, and each served by a supply system on the head; the cylinders being divided into a first and second group, each composed of pairs of first and second cylinders arranged in a V and converging towards a respective drive shaft for each group; characterized in that the cylinders in the two groups are connected inverted and facing one another, so that the first and second cylinders in the first group form respective first and second in-line banks connected, at the respective head end, so as to form a V with the first and second cylinders respectively of corresponding first and second in-line banks in the second group, and so that each pair of converging cylinders in the first banks of the two groups defines a first common combustion chamber, and each pair of converging cylinders in the second banks of the two groups defines a second common combustion chamber; said first and second common combustion chambers defined by the converging corresponding cylinders in the two groups of cylinders present, in a plane parallel to that of the respective first and second heads, the form of an ellipse defined by interpenetration of the respective cylindrical side walls of the respective said converging cylinders in the two groups; the angle between the axis of the cylinders in each pair of converging cylinders and the plane parallel to that of the respective head being so selected as to maximize the longer axis of said ellipse, and so permit the same block to be fitted with heads with both four and six valves for each combustion chamber defined by each pair of converging corresponding cylinders in the two groups.

2. An engine as claimed in claim 1, characterized in that said two groups of two banks of V cylinders are formed in a single common block wherein, in cross section, the cylinders are arranged in the form of a quadrilateral, and which presents, on either side, a first and second number of main bearings for a first and second drive shaft, respective first connections for a first and second oil sump, and, perpendicular to the first connections, second connections for a first and second head.

3. An engine as claimed in claim 2, characterized in that it is so formed as to be installed with said first oil sump at the bottom, said second oil sump inverted at the top, and the two heads opposed horizontally; the heads comprising respective intake pipes at the top, on either side of said second oil sump, and respective exhaust pipes at the bottom, on either side of the first oil sump.

4. An engine as claimed in claim 3, characterized in that said common block for the two groups of two banks of V cylinders presents a first number of vertical passages formed at the respective ends of the first and second cylinders in each group converging towards the drive shaft, for maintaining constant communication, at the same pressure, between the first and second oil sumps.

5. An engine as claimed in claim 4, characterized in that said common block for the two groups of two banks of V cylinders presents a second number of vertical passages connecting the cylinders in the corresponding banks in the two groups at the respective side walls of the cylinders.

6. An engine as claimed in claim 2, characterized in that, for each said cylinder, it comprises at least one nozzle located at the end of the cylinder facing the respective drive shaft; the nozzle in turn being arranged facing the opposite end of the cylinder, for spraying oil on to the crown of the respective piston sliding inside the cylinder, on the opposite side to the combustion chamber.

7. An engine as claimed in claim 2, characterized in that said pistons present a convex crown with its convexity towards the combustion chamber; and, in combination, the pistons are connected by respective connecting rods to said drive shafts by means of respective pins located upstream from respective sealing elements of the pistons in relation to the combustion chamber.

8. An engine as claimed in claim 7, characterized in that the pistons present a saddle-shaped crown towards the combustion chamber and defined by a pair of substantially perpendicular faces; the stroke of the pistons being so selected that, in the top dead center position, respective first faces of the pistons are positioned facing and adjacent to each other and parallel to and on either side of the axis of convergence of the cylinders in the two groups, and respective second faces of the pistons are positioned parallel to, coplanar with, and facing a respective said head of the engine.

9. An engine as claimed in claim 8, characterized in that said heads are so formed as to define, in cross section, a "roofed" type combustion chamber in relation to each pair of converging first or second cylinders respectively, with respective supply valves and drain valves arranged obliquely in relation to each other and facing said second faces of the pistons of said converging cylinders; in the top dead center position, a very small clearance existing between said first faces of the pistons and between the second faces of the pistons and the respective said head.

* * * * *